US006872280B2

(12) United States Patent
Tanaka et al.

(10) Patent No.: US 6,872,280 B2
(45) Date of Patent: Mar. 29, 2005

(54) SLURRY COLLECTION DEVICE AND METHOD

(75) Inventors: Shunsuke Tanaka, Otsu (JP); Masami Shinohara, Yasu-gun (JP); Kohichi Ishimoto, Rittou (JP)

(73) Assignee: International Business Machines Corporation, Armonk, NY (US)

( * ) Notice: Subject to any disclaimer, the term of this patent is extended or adjusted under 35 U.S.C. 154(b) by 15 days.

(21) Appl. No.: 10/248,910

(22) Filed: Feb. 28, 2003

(65) Prior Publication Data

US 2003/0164356 A1 Sep. 4, 2003

(30) Foreign Application Priority Data

Mar. 1, 2002 (JP) ..... 2002-055665

(51) Int. Cl.[7] ..... C23F 1/00; H01L 21/306

(52) U.S. Cl. ..... 156/345.12

(58) Field of Search ..... 156/345.12, 345.13, 156/345.15, 345.18

(56) References Cited

U.S. PATENT DOCUMENTS 4,161,356 A * 7/1979 Giffin et al. ..... 396/625
4,871,417 A * 10/1989 Nishizawa et al. ..... 438/748
5,608,943 A * 3/1997 Konishi et al. ..... 15/302
5,871,584 A * 2/1999 Tateyama et al. ..... 118/323
5,940,651 A * 8/1999 Pike et al. ..... 396/604
5,985,357 A * 11/1999 Sanada ..... 427/8
6,332,751 B1 * 12/2001 Kozawa et al. ..... 414/816

FOREIGN PATENT DOCUMENTS

JP 11087284 A2 3/1999
JP 11221511 A * 8/1999 ..... B05C/5/02
JP 20108018 A2 4/2000
JP 20246625 A2 9/2000
JP 20308967 A2 11/2000

* cited by examiner

*Primary Examiner*—P. Hassanzadeh
*Assistant Examiner*—Roberts Culbert
(74) *Attorney, Agent, or Firm*—Ira D. Blecker

(57) ABSTRACT

A slurry collection device 1 includes a ring-shaped barrier member 2 provided around a turntable T of a polishing machine E and a ring-shaped slurry collection container 3 provided around the barrier member 2. The turntable T is connected to an upper end of a main rotation shaft T1 that sticks out from a bottom portion of a sink S of the polishing machine E and is lifted from the bottom portion of the sink S. The slurry collection device 1 of the present invention is inserted between the turntable T and the sink S.

11 Claims, 7 Drawing Sheets

SLURRY COLLECTION DEVICE AND METHOD

BACKGROUND OF INVENTION

The present invention relates to a device and a method for collecting a part of slurry. In a semiconductor production process, slurry is used as an abrasive agent for polishing a silicon wafer and is supplied to a polishing machine.

DESCRIPTION OF RELATED ART

In chemical mechanical polishing (hereinafter referred to as "CMP") in the semiconductor production process, a thin disc-like silicon wafer is pressed on a polishing pad while being rotated using a polishing machine, and, at the same time, slurry is supplied between the silicon wafer and the polishing pad to polish the silicon wafer. Such CMP combines the chemical removal effect of chemical components contained in slurry and abrasive material (e.g. alumina or silica particles) with the mechanical effect provided by polishing a silicon wafer with a polishing pad.

Conventionally, a polishing machine E shown in FIG. 6 or 7 has been used for performing the aforementioned CMP. The polishing machine E comprises: a turntable T that has a polishing pad P on the upper surface thereof and that rotates around a main rotation shaft T1; and a polishing head H for pressing a silicon wafer W on the polishing pad P while rotating the wafer W around a rotation shaft H1 that is eccentric to the main rotation shaft T1 of the turntable T. The aforementioned slurry is poured down from an end A1 of a slurry supply nozzle A provided above the turntable T to the polishing pad P on the turntable T.

When the slurry is left to stand for a long time for maintenance or the like, a part of the slurry left in the slurry supply nozzle A or adhering to the polishing pad is coagulated or precipitated, and further it gets dry and becomes solid in some cases. Such precipitated or coagulated slurry causes scratches on the surface of the silicon wafer during the CMP process.

In order to solve this problem, prior to performing the CMP process, a test run of the polishing machine E is made using a dummy wafer, instead of the silicon wafer W. During the test run, fresh slurry is supplied to the polishing machine E by opening an open/close valve B provided to the slurry supply nozzle A as shown in FIG. 8, so as to let out the coagulated or precipitated slurry from the slurry supply nozzle A and to wash away the slurry adhering to the turntable T. Further, in some cases, a selector valve is provided instead of the open/close valve B so as to purge a downstream side A2 of the nozzle A with pure water and simultaneously to wash away the slurry adhering to the turntable T with the pure water. The pure water is supplied not only during the test run but also just before the completion of the CMP to wash away the slurry on the turntable. In some cases, pure water is supplied to prevent the slurry or polishing pad P from drying.

However, during the test run, the slurry poured down from the slurry supply nozzle A onto the turntable T of the polishing machine E or the slurry mixed with pure water supplied just before the completion of CMP or supplied for preventing drying is disposed of through a discharge outlet D shown in FIG. 7 without being used for the CMP. The main reasons to dispose of such slurry are because solid contents of such slurry are unevenly distributed or because such slurry is diluted with a large amount of pure water so that it is difficult to reuse.

However, in the conventional polishing machine E, reusable slurry must be also disposed of with the aforementioned unreusable slurry because of structural reasons of the machine E. In the CMP process, fresh slurry is supplied through the slurry supply nozzle A. Such fresh slurry is reusable because it does not contain any water; however, it is disposed of through the discharge outlet D together with unreusable slurry after it is poured down to the turntable T shown in FIG. 7.

Therefore, all the slurry disposed of through the outlet D is mixed together in a discharge pipe connected with the outlet D. Since such mixture contains unevenly-distributed solid contents and is diluted with pure water, there is no choice but to dispose of it.

As stated above, the accumulation of slurry wastes causes price rise of the CMP. Further, when a large amount of slurry is continuously discharged from the discharge output D, the output D is clogged with solid contents of the slurry, and thus frequent maintenance services are required.

An object of the present invention is to provide a slurry collection device and method that can reduce the amount of slurry to be wasted and that can prevent a slurry discharge pipe from being clogged.

SUMMARY OF INVENTION

A slurry collection device according to the present invention comprises: a slurry collection container which is provided around a turntable of a polishing machine and into which slurry on the turntable flows by centrifugal force caused by the rotation of the turntable; and a barrier member for preventing or allowing the flow of the slurry into the slurry collection container.

Another slurry collection device according to the present invention comprises: an inclined guide member which is provided around a turntable lifted from a bottom of a sink of a polishing machine, which is moved up and down between a higher place and a lower place than an upper surface of the turntable, and which is inclined outward in the radial direction of the turntable; a barrier member which is attached to an lower surface of the inclined guide member and which surrounds the upper surface of the turntable when it is moved up to the higher position than the upper surface of the turntable; and a slurry collection container which is provided around the barrier member and which is placed just under an outer edge of the inclined guide member.

A slurry collection method according to the present invention comprises the steps of: polishing a workpiece while slurry is poured down to a turntable of a polishing machine; collecting the slurry flowing down from the edge of the turntable; and discharging the slurry flowing down from the edge of the turntable from the polishing machine.

DETAILED DESCRIPTION

Figure 1:
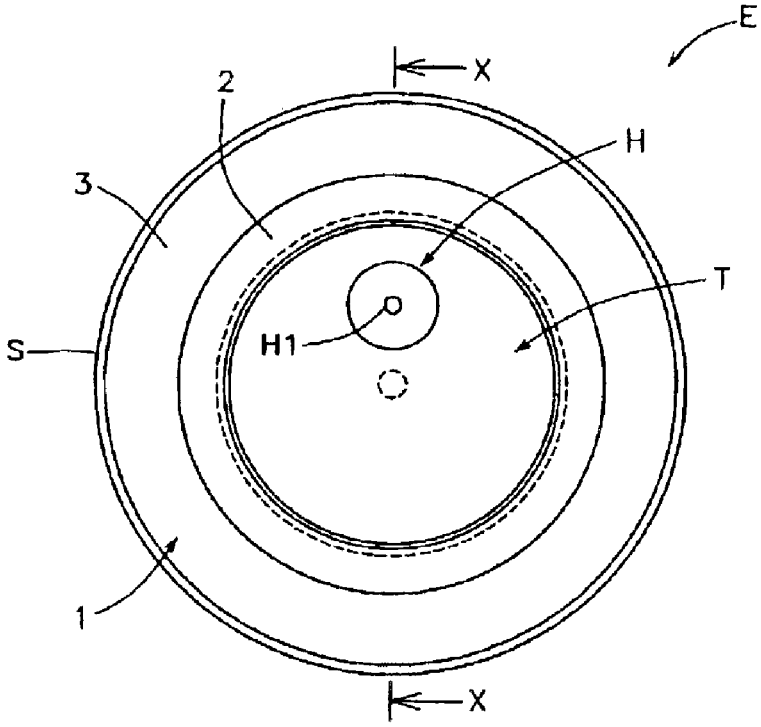
FIG. 1 is a plan view of a major part of a slurry collection device according to the present invention.

Embodiments of a slurry collection device and method according to the present invention will be described below. In the following embodiments, like reference characters denote the same components as conventional ones, so that a detailed explanation will not be given.

Figure 2:
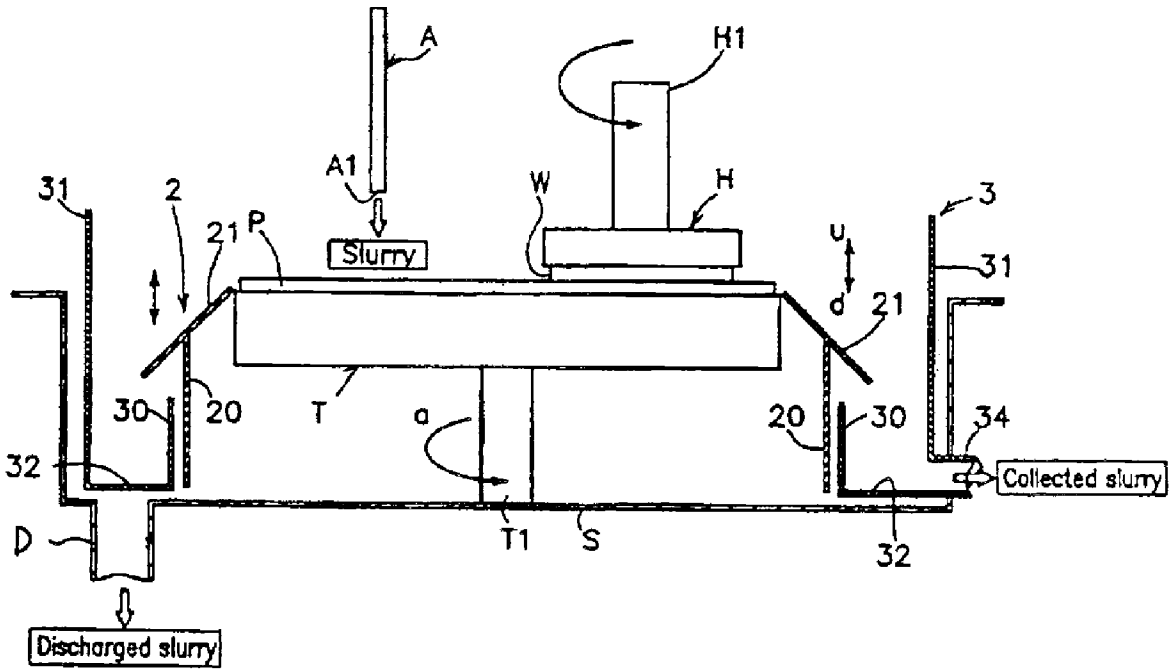
FIG. 2 is a sectional view taken on line X—X for showing that a barrier member of the slurry collection device according to the present invention is moved down.
Figure 3:
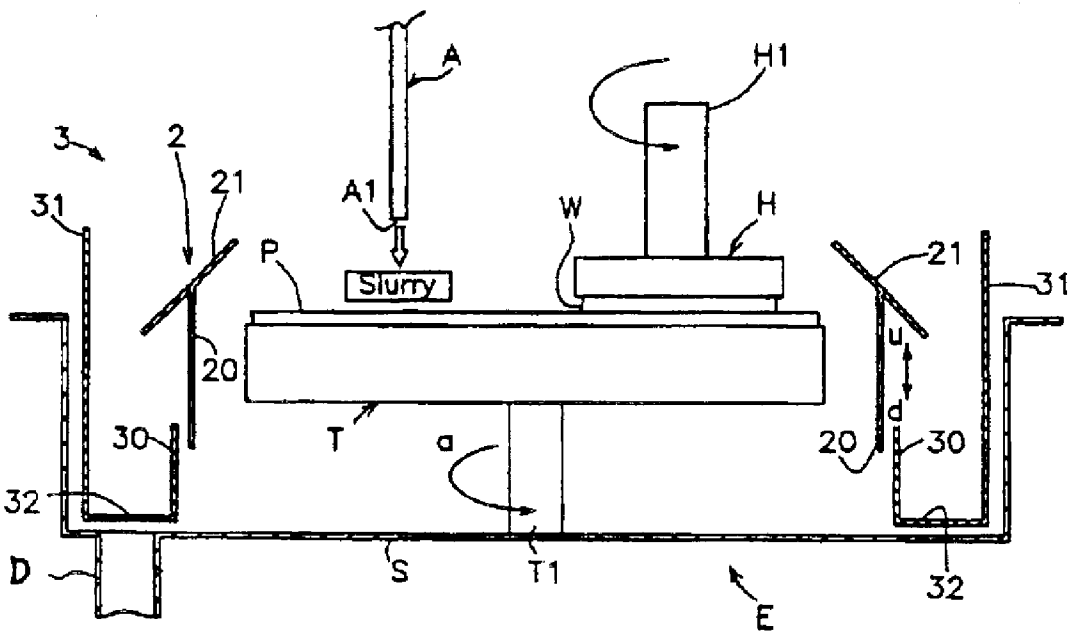
FIG. 3 is a sectional view taken on line X—X for showing that the barrier member is moved up.

As shown in FIG. 1, a slurry collection device 1 comprises: a ring-shaped barrier member 2 provided around a turntable T of a polishing machine E; and a ring-shaped slurry collection container 3 provided around the barrier member 2. FIGS. 2 and 3 each are a sectional view taken on line X—X of FIG. 1. The turntable T is attached to an upper end of a main rotation shaft T1 that sticks out from a bottom portion of a sink S of the polishing machine E and is lifted from the bottom portion of the sink S. The slurry collection device 1 of the present invention is inserted between the turntable T and an inner side surface of the sink S.

The barrier member 2 comprises: a short cylindrical body portion 20 whose inner diameter is larger than the outer diameter of the turntable T; and an inclined guide member 21 that is inclined outward in the radial direction of the turntable T (toward the inner side surface of the sink S). The inclined guide member 21 is connected to the upper end of the body portion 20. The barrier member 2 may be an excellent corrosion-resistant thin plate made of stainless steel which is rolled and spread by applying pressure and which is formed into a desired shape by plastic forming. Alternatively, if the barrier member 2 is made of thermoplastic synthetic resin, the body portion 20 and the inclined guide member 21 can be integrally produced. Thus, the structure of the member 2 can be simplified, and material cost and production cost can be reduced.

An actuator that linearly moves as shown by arrows u and d in FIG. 2 moves up and down the body portion 20 of the barrier material 2 within a stroke range thereof or stops it at an desired height. Any known technology such as an air cylinder and hydraulic cylinder can be used as an actuator, so that the actuator is not shown in the drawings. For example, where an air cylinder is placed on the underside of the sink S, a hole is bored in the bottom of the sink S and an actuating rod of the cylinder is connected to a lower end of the body 20 through the hole. Further, a gap between the hole and the rod is sealed with packing material. There may be a plurality of air cylinders provided. Regardless of the motion of the actuator, the barrier member 2 may be moved up and down by hand.

The inside diameter of the slurry collection container 3 is slightly wider than the outside diameter of the body portion 20, and the outside diameter thereof is slightly narrower than the inside diameter of the sink S. The slurry collection container 3 is shaped like a groove in cross section which is composed of an inner upright portion 30 facing the outer peripheral surface of the body portion 20, an outer upright portion 31 facing the inner peripheral surface of the sink S, and a bottom portion 32 that connects the lower ends of the upright portions 30 and 31.

The upper end of the inner upright portion 30 is nearer to the turntable T than the lower end (outer end portion) of the inclined guide member 21. When the barrier member 2 is moved down to the lowest limit as shown in FIG. 2, the upper end of the upright portion 30 enters into an inside corner between the inclined guide member 21 and the body portion 20. The upper end of the outer upright portion 31 is higher than the upper surface of the turntable T.

In the CMP process, the turntable T rotates in the direction shown by an arrow A in FIG. 2. The slurry flowing down to the turntable T from the slurry supply nozzle A is forced to the periphery of the turntable T by centrifugal force. At this time, the barrier member 2 is moved down as shown in FIG. 2, and the upper end (inner end portion) of the inclined guide member 21 becomes lower than the upper surface of the turntable T.the slurry forced to the periphery of the turntable T does not drop into the sink S but is received by the upper surface of the inclined guide member 21. The centrifugal force is not exerted on the slurry on the inclined guide member 21. The slurry slides down the inclined guide member 21 and then drops into the slurry collection container 3.

However, when the turntable T is rotated at relatively high speed, the slurry is forced to the periphery of the turntable T by strong centrifugal force and therefore scattered from the turntable T by inertia force. The scattered slurry drops directly into the groove-shaped member 3, or collides with the outer upright portion 31 and then falls down to the groove-shaped member 3 along the upright portion 31.

Further, the slurry collection container 3 has a drainage slope. The slurry flows along the drainage slope and is discharged from a discharge outlet 34 provided to an appropriate place of the slurry collection container 3. The slurry discharged from the outlet 34 is hereinafter referred to as "collected slurry". The collected slurry is pumped up by a motor pump or the like that is connected to the outlet 34, and then re-supplied to the turntable T through the slurry supply nozzle A. This means that the collected slurry is not led to an outlet D of the sink S, but it circulates through the slurry supply nozzle A, turntable T, inclined guide member 21, and groove-like member 3 and is reused in the CMP process.

Next, there will be described the case where the polishing machine E is stopped for maintenance or the like for a long time and then a trial run is made, or where the polishing machine E is purged with pure water, or where pure water is supplied to the polishing machine E. The trial run comprises the step of purging slurry remained in the slurry supply nozzle A and slurry adhering to the turntable T with fresh slurry that is supplied from the slurry supply nozzle A or the step of purging such slurry with pure water.

When the slurry on the turntable T is purged with pure water just before the completion of the CMP process and when pure water is supplied so as to prevent the slurry or the polishing pad P from drying during the aforementioned test run, the turntable is continuously rotated. The slurry or pure water poured down to the turntable T is forced to the periphery of the turntable T by centrifugal force. At this time, the barrier member 2 is moved to the upper limit so that the upper end of the inclined guide member 21 becomes higher than the upper surface of the turntable T, as shown in FIG. 3.

The slurry or pure water forced to the periphery of the turntable T drops to the sink S, or the slurry or pure water scattered from the turntable T by centrifugal force collides with the inner surface of the body 20 and then flows down to the sink S along the inner surface of the body 20. Further, the slurry or pure water is discharged to the outlet D provided in the bottom of the sink S. Such slurry, pure water, or a mixture of such slurry or pure water is hereinafter referred to as discharged slurry. The discharged slurry can be hardly reused because it has unevenly distributed solid contents or is diluted with a large amount of pure water.

The aforementioned up and down motion of the barrier member 2 is preferably controlled by an electric signal based on the operation of the polishing machine E. Specifically, a control means (not shown) equipped with a microprocessor or the like is provided. A solenoid valve is provided in the middle of the slurry supply pipe A and is used as an open/close valve B or a selector valve. When slurry is supplied to the turntable T through the solenoid valve while the turntable T is being rotated, the control means detects the open/close condition or on/off condition of the solenoid valve as a certain electric signal.

The controlling means detects, as a different electric signal, that the slurry is not supplied to the polishing machine E by the solenoid valve for more than predetermined period of time during the suspension of the machine E, or that pure water is supplied to the turntable T through the solenoid valve. Then, the control means controls the actuator for moving up and down the barrier member 2. Specifically, the controlling means moves down the barrier member 2 on the basis of a certain electric signal, while it moves up the member 2 on the basis of a different electric signal. As means for measuring the time for which the polishing machine E is suspended and sending out an electric signal, a timer circuit is used.

Figure 4:
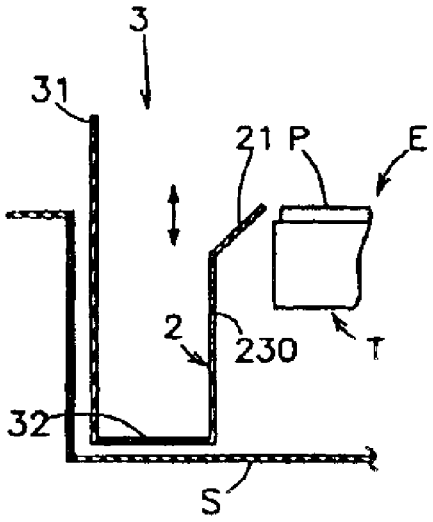
FIG. 4 is a sectional view showing a variation of the slurry collection device according to the present invention.

As shown in FIG. 4, the inner upright portion 30 of the slurry collection container 3 may be integrally formed with the body portion 20 of the barrier member 2 to form body portion 230 so that the slurry collection container 3 can move up and down together with the barrier member 2. This makes it easier to attach and detach the container 3 to and from the polishing machine E for cleaning. Further, when the slurry collection container 3 and the barrier member 2 are made of synthetic resin, the total weight of the slurry collection device 10 can be lightened. Thus, the load on the actuator that moves up and down the device 10 can be reduced, and therefore the actuator can be miniaturized.

Figure 5:
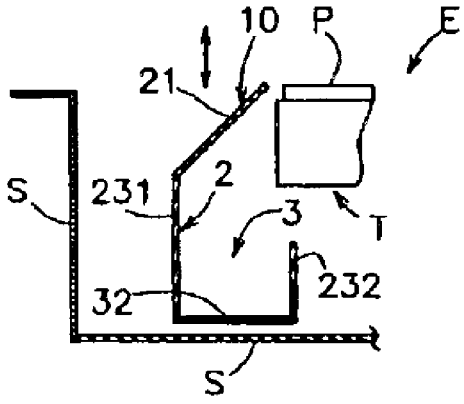
FIG. 5 is a sectional view showing another variation of the slurry collection device according to the present invention.
Figure 6:
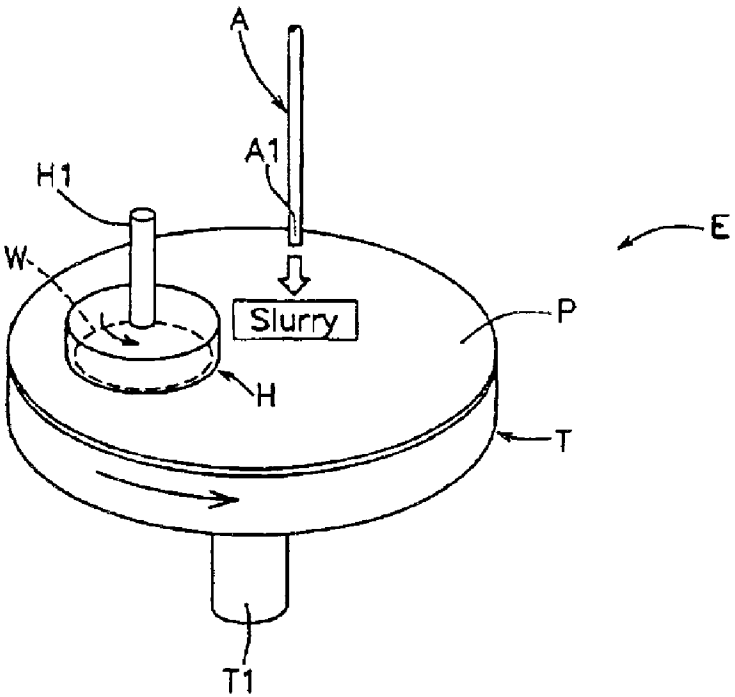
FIG. 6 is a perspective view showing a major part of a conventional polishing machine.
Figure 7:
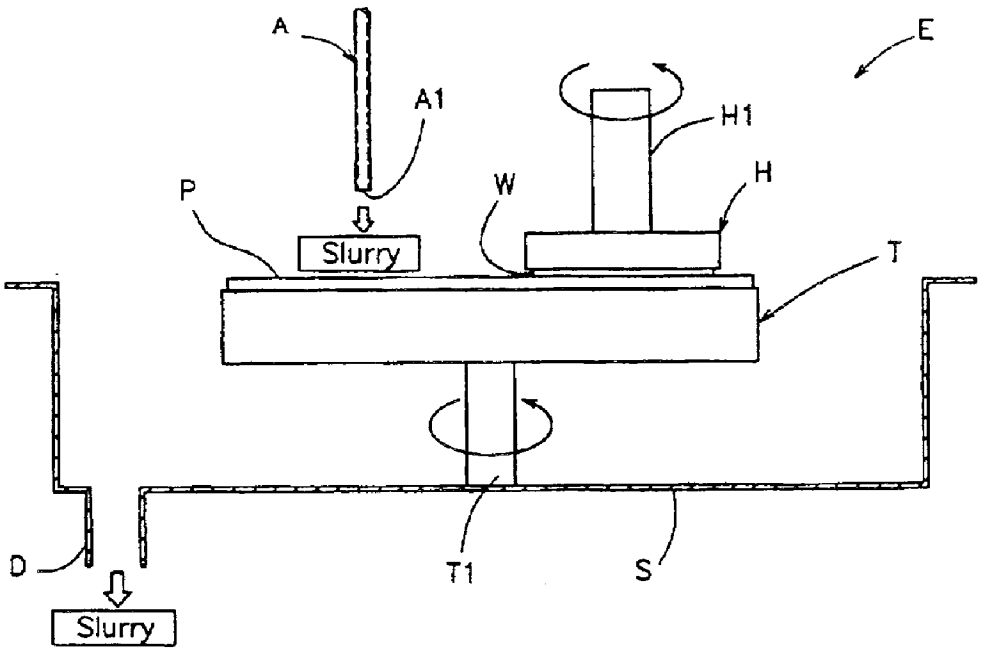
FIG. 7 is a partial sectional view showing a major part of a conventional polishing machine.
Figure 8:
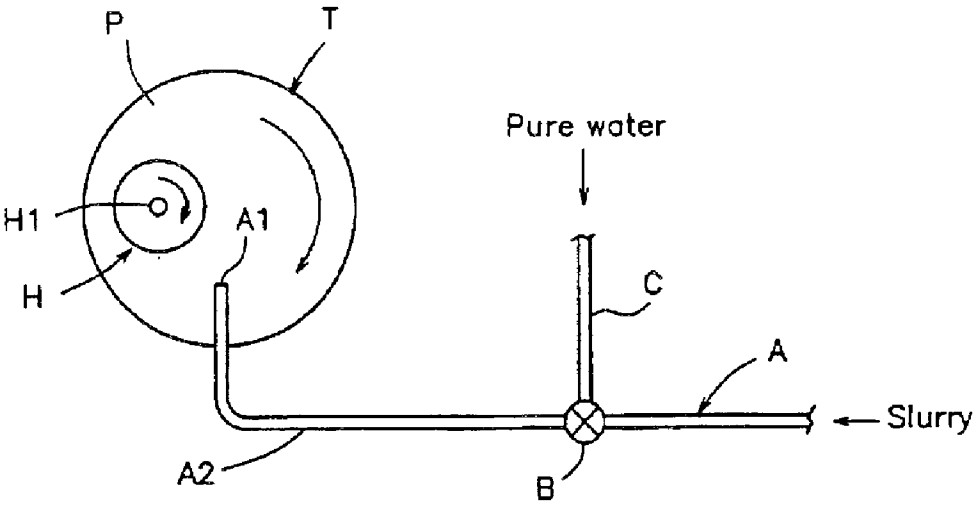
FIG. 8 is a plan view showing a major part of a conventional polishing machine.

Further, the collected slurry may be led into the slurry collection container 10 in such a manner as shown in FIG. 5. Specifically, inward from a body portion 231 of the barrier member 2 are provided a bottom portion and an upright portion 232 to form a slurry collection container 3. The container 3 thus formed is shaped like a groove in cross section.

When a slurry collection device 10 thus formed is moved up, the collected slurry is led into the slurry collection container 3. On the contrary, when the slurry collection device 10 is moved down, the discharged slurry flows down from the turntable T and then drops into the sink S along the inclined guide member 21. In this case, the slurry collection device 10 comprises a reduced number of parts, which makes the structure of the device 10 simple and makes it easy to clean up the device 10.

As stated above, the collected slurry is circulated during the CMP process using the polishing machine E. In the meanwhile, when a trial run is made after the polishing machine E is stopped for a long period of time or when pure water is supplied to the turntable T, the discharged slurry can be discharged to the discharge pipe D. Since the collected slurry and the discharged slurry are separated and only the collected slurry is reused, the total amount of slurry to be used in the CMP process can be saved, and the CMP cost can be thereby reduced.

Moreover, since the slurry collection container 3 is provided near the turntable T, the slurry dropping from the turntable T is collected into the slurry collection container 3 in the shortest distance. Therefore, there is little possibility of mixing foreign substances into the collected slurry.

Further, the slurry is discharged from the discharge pipe D only when a trial run is being made or when pure water is supplied to the turntable T. Since a large amount of slurry does not continuously flow into the discharge pipe, the discharge pipe is less frequently clogged with solid contents of the slurry. Therefore, the slurry collection device of the present invention requires less maintenance services such as cleaning of the discharge pipe D.

According to the slurry collection device and method of the present invention, slurry can be circulated and reused during a CMP process using a polishing machine. Specifically, after the polishing machine is stopped for a long time or when pure water is supplied to a turntable, slurry, pure water, or the mixture of the slurry and pure water can be discharged from the polishing machine so as not to be mixed with fresh slurry to be used in the CMP process. The concentration of the slurry to be used in the CMP process can be thereby kept constant, so that the slurry used in the CMP process can be reused repeatedly. Thus, the slurry is not wasted but can be saved in the CMP process, and the CMP cost can be reduced.

Further, the slurry is discharged only after the polishing machine is stopper for a long time or when pure water is supplied to the turntable T. Since a large amount of slurry does not continuously flow into the discharge pipe, the discharge pipe is less frequently clogged with solid contents of the slurry. Therefore, the slurry collection device of the present invention requires less maintenance services such as cleaning of the discharge pipe.

While the embodiments of the present invention have thus been described with reference to the drawings, it should be understood that the present invention be not limited to the embodiments. Many changes, modifications, variations and other uses and applications can be made to the embodiments on the basis of knowledge of those skilled in the art without departing from the scope of the present invention. Further, any of the specific inventive aspects of the present invention may be replaced with other technical equivalents for embodiment of the present invention, as long as the effects and advantages intended by the invention can be insured.

What is claimed is:

1. A polishing machine having a slurry collection device comprising:

a turntable;

a slurry collection container provided around the turntable, wherein the slurry collection container is fixed in position; and a barrier member for preventing or allowing the flow of a fluid comprising a slurry or water from the turntable into the slurry collection container, wherein the barrier member is moveable with respect to the slurry collection container.

2. A polishing machine having a slurry collection device comprising:

a sink fixed position;

a turntable lifted from a bottom of the sink;

an inclined guide member provided around the turntable and moved up and down with respect to the sink between a higher place and a lower place with respect to an upper surface of the turntable, and inclined outward in the radial direction of the turntable;

a barrier member moved up and down with the inclined guide member and surrounding the upper surface of the turntable when the inclined guide member is moved up to the higher place; and a slurry collection container provided around the barrier member and placed just under an outer edge of the inclined guide member.

3. The polishing machine according to claim 2, further comprising an actuator for moving up and down the inclined guide member.

4. The polishing machine according to claim 3, further comprising control means for controlling the up and down motion of the actuator.

5. The polishing machine according to claim 4, wherein said control means controls the up and down motion of the actuator by an electric signal based on the operation of the polishing machine.

6. The polishing machine according to claim 5, wherein said electric signal is transmitted from a solenoid valve provided to a pipe line for supplying a slurry or pure water to the polishing machine.

7. The polishing machine according to claim 5, wherein said electric signal is transmitted from a timer circuit for measuring the time for which a slurry supply to the polishing machine is suspended by the solenoid valve.

8. The polishing machine according to claim 7, wherein said control means moves up the barrier member on the basis of the electric signal transmitted from the timer circuit.

9. The polishing machine according to claim 6, wherein said control means moves up the barrier member on the basis of the electric signal transmitted when the solenoid valve allows the supply of pure water to the polishing machine.

10. The polishing machine according to claim 7, wherein said control means moves down the barrier member on the basis of the electric signal transmitted when the solenoid valve allows the slurry supply to the polishing machine.

11. The polishing machine according to claim 2, wherein said inclined guide member, said barrier member, and said slurry collection container are integrally formed.

* * * * *